US006431427B1

(12) United States Patent
Leitner

(10) Patent No.: US 6,431,427 B1
(45) Date of Patent: Aug. 13, 2002

(54) NAILING DEVICE

(76) Inventor: Helmut Leitner, St. Georgen Klaus 102, A-3340 Waidhofen/Ybbs (AU)

( * ) Notice: Subject to any disclaimer, the term of this patent is extended or adjusted under 35 U.S.C. 154(b) by 68 days.

(21) Appl. No.: 09/714,867

(22) Filed: Nov. 17, 2000

Related U.S. Application Data

(63) Continuation-in-part of application No. PCT/EP00/02101, filed on Apr. 10, 2000.

(30) Foreign Application Priority Data

Mar. 18, 1999 (AT) ..... 489/99

(51) Int. Cl.[7] ..... B25C 5/06
(52) U.S. Cl. ..... 227/119; 227/136; 227/138
(58) Field of Search ..... 227/138, 129, 227/136, 119, 120, 134; 173/210, 211

(56) References Cited

U.S. PATENT DOCUMENTS 1,123,221 A * 1/1915 Beckley ..... 227/138
1,542,340 A * 6/1925 Crofoot ..... 227/138
1,582,223 A * 4/1926 Polzer ..... 227/138
4,129,941 A * 12/1978 Zahn ..... 227/138
5,339,983 A * 8/1994 Caple ..... 227/138
6,027,004 A * 2/2000 Ramella et al. ..... 227/119

* cited by examiner

*Primary Examiner*—Scott A. Smith
(74) *Attorney, Agent, or Firm*—Cahn & Samuels, LLP

(57) ABSTRACT

A nailing device for a coiled nail belt is provided. The nailing device includes an upper part that resembles a hammer handle at the end and has a miter gage at an opposite end. The upper part also includes an arm component having a magazine, a hammerhead and a nail feed. The hammerhead includes a drive hole in which a striker set on a bearing bolt in the miter gage may be guided. The nailing device further includes a rocker arm which is coupled to a shaft in the hammerhead and which, upon activation of the nailing device, displaces a feeder in an opening in the hammerhead, moves the shaft and extends through an opening in the rocker arm. The area between the border of the opening and the shaft is filled with rubber filler.

16 Claims, 6 Drawing Sheets

NAILING DEVICE

This application is a continuation in part of PCT/EP00/02101 filed in the name of Helmut Leitner on Mar. 10, 2000.

FIELD OF THE INVENTION

The invention relates to nailing devices of a type common used by roofers. More particularly, the invention relates to nailing devices, that employ metal alloy nail belts.

BACKGROUND OF THE INVENTION

Nail belts are used in nailing devices that are operated with compressed air, gas, electricity or manually. Typically, a nail belt will be placed in a nail magazine containing up to 140 parallel oriented nails that are linked with a wire that is welded to the nail shafts. The malleability of the wire permits coiling of the nail band for insertion in a suitable nailing device. Typical nail belts employ connecting wires consisting of soft unalloyed metals.

A known nailing device is described in European Patent No. 321 440 81. Operating nail belts in such a nailing device is difficult because the driving motion of the nailing device compresses the spacing between nails. Furthermore, the nails are undesirably repositioned towards the magazine center. In practice malfunctions may occur in the nailing device repeatedly since, as noted, the nails jam inside the nailing device when they are turned. In addition, the nails are shortened and repositioned by the hammer component of the nailing device. In particular, this malfunction occurs when a large part of the nail band has been used and the remainder of the nail coil lies loose in the nail magazine.

Nail driving requires strong forces. However these forces often have negative affects on nailing device bearings. Therefore, wear and tear quickly appears and results in considerable give on the bearings as well as inexact guidance and nail feed. Accordingly, there is a need for a nailing device that overcomes the foregoing problems.

SUMMARY OF THE INVENTION

It is an object of the present invention to provide a nailing device that smoothly delivers nails without significant nail jam.

It is another object of the invention to provide a nailing device that aligns nails for delivery with a high degree of precision.

It is a further object of the invention to provide an improved nail belt that resists nail jam.

It is yet another object of the invention to overcome the problems associated with prior art nailing devices.

In accordance with an embodiment of the invention, a nailing device is provided for use with nails on a belt. The nailing device generally includes an upper part that may resemble a hammer handle. The upper part preferably includes a miter gage and an arm component which contains a nail magazine. A nail feeder is provided in communication with the nail magazine having a hammerhead disposed near an end thereof. The hammerhead may include a drive hole in which a striker is located next to a bearing bolt in the miter gage. A rocker arm preferably engages the nail feeder such that, during operation of the nailing device, the nail feeder feeds nails to the drive hole of the hammerhead.

DETAILED DESCRIPTION OF THE EMBODIMENTS

Figure 1:
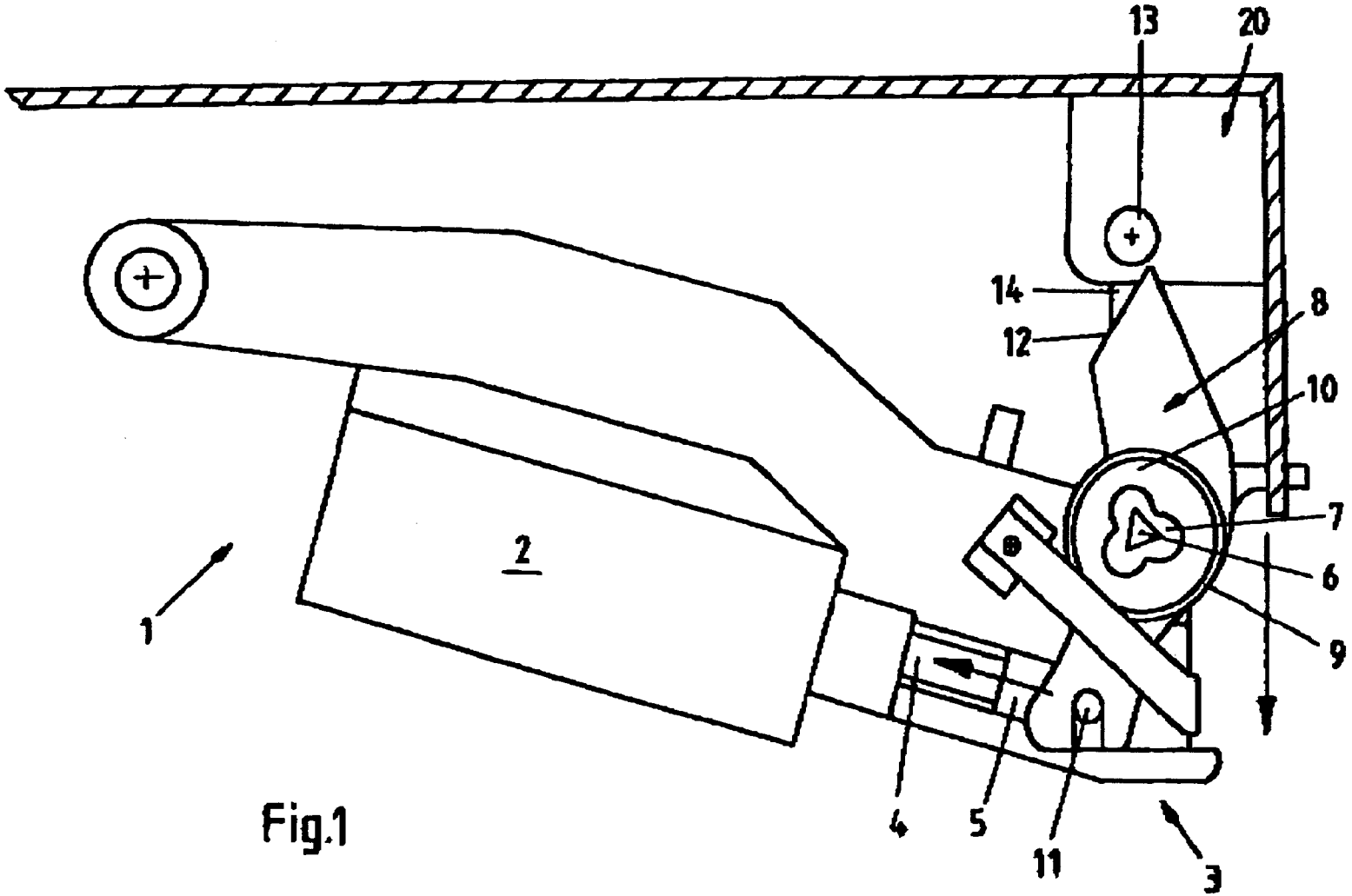
FIG. 1 shows the arm component of the nail device in lateral view and a section of the upper part of the nailing device lying opposite to it.

FIG. 1 shows an arm part 1 with the nail magazine 2 and a hammerhead 3. In the hammerhead 3, an opening 4 is provided in which a moveable feeder 5 is placed. The hammerhead 3 is coupled to a shaft 6 that is preferably triangular in cross-section and firmly rests into a star-shaped casing 7 and extends through an opening in the rocker arm 8. The opening is bounded by a ring 9 and the area between the edge of the opening and the star-shaped casing 7 is preferably filled with a rubber filler 10. The star shaped casing 7 is preferably fixed in relation to shaft 6 and forms a durable friction fit connection with rubber filler 10. Ring 9 enlarges the surface area of the rocker arm 8 contacting rubber filler 10 thus enhancing the durability of the rocker arm/rubber filler interface.

The rocker arm 8 may be fork-shaped at one end and preferably surrounds bolt 11, so that the fork of the rocker arm 8 moves the feeder 5 with bolt 11 as the rocker arm 8 turns. A the end of the rocker arm 8 a contact surface 12 turned away from the feeder 5 is provided, which slides along a contact bolt 13 disposed in the miter gage 20 and thus shifts the rocker arm 8. A striker 14 may be attached to arm part 1 by the contact bolt 13.

FIG. 1 shows the nailing device in released state. The nailing device is preferably activated by applying a force to hammerhead 3. This force then causes rocker arm 8 to rotate against rubber filler 10 and striker 14 to move downward through drive hole 15 and strike nail 16 to drive nail 16 into the desired surface. When the nailing process is finished, the striker 14 is retracted into a drive hole 15 (FIG. 4) and the rubber filler 10, which is under tension, resets the rocker arm 8 into the position shown in FIG. 1. In the process, the contact surface 12 of the rocker arm 8 slides back along the contact bolt 13 and the feeder 5 is brought into its particular position close to the drive hole 15 in the hammerhead 3 so that the next nail may be positioned in drive hole 15.

Figure 3:
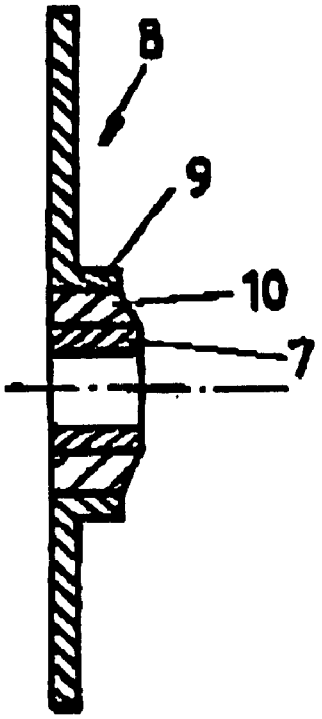
FIG. 3 shows the rocker arm in a section.
Figure 2:
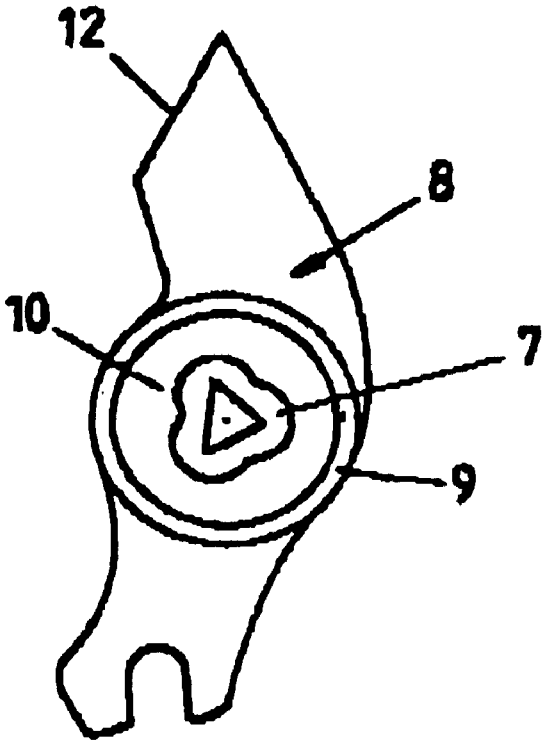
FIG. 2 shows the rocker arm in a lateral view.

In FIGS. 2 and 3 depict the rocker arm 8 in combination with the ring 9. The rocker arm 8 is preferably integrally formed with ring 9. Within the ring 9 a star-shaped casing 7 may be disposed that preferably has a triangular opening to engage shaft 6. Between the star-shaped casing 7 and the ring 9 as well as the opening in the rocker arm 8 a rubber filler 10 is vulcanized so that the rocker arm 8 can be turned against the elastic force of the rubber filler 10 when the shaft 6 rests into the casing 7. Disposed at one end the rocker arm 8 is a contact surface 12 that interacts with the contact bolt 13 during installation in the nailing device. On the opposite end the rocker arm 8 is a fork-shaped extension. This fork surrounds the bolt 11 of the feeder 5 and moves it into the opening 4 of the hammerhead 3.

Figure 4:
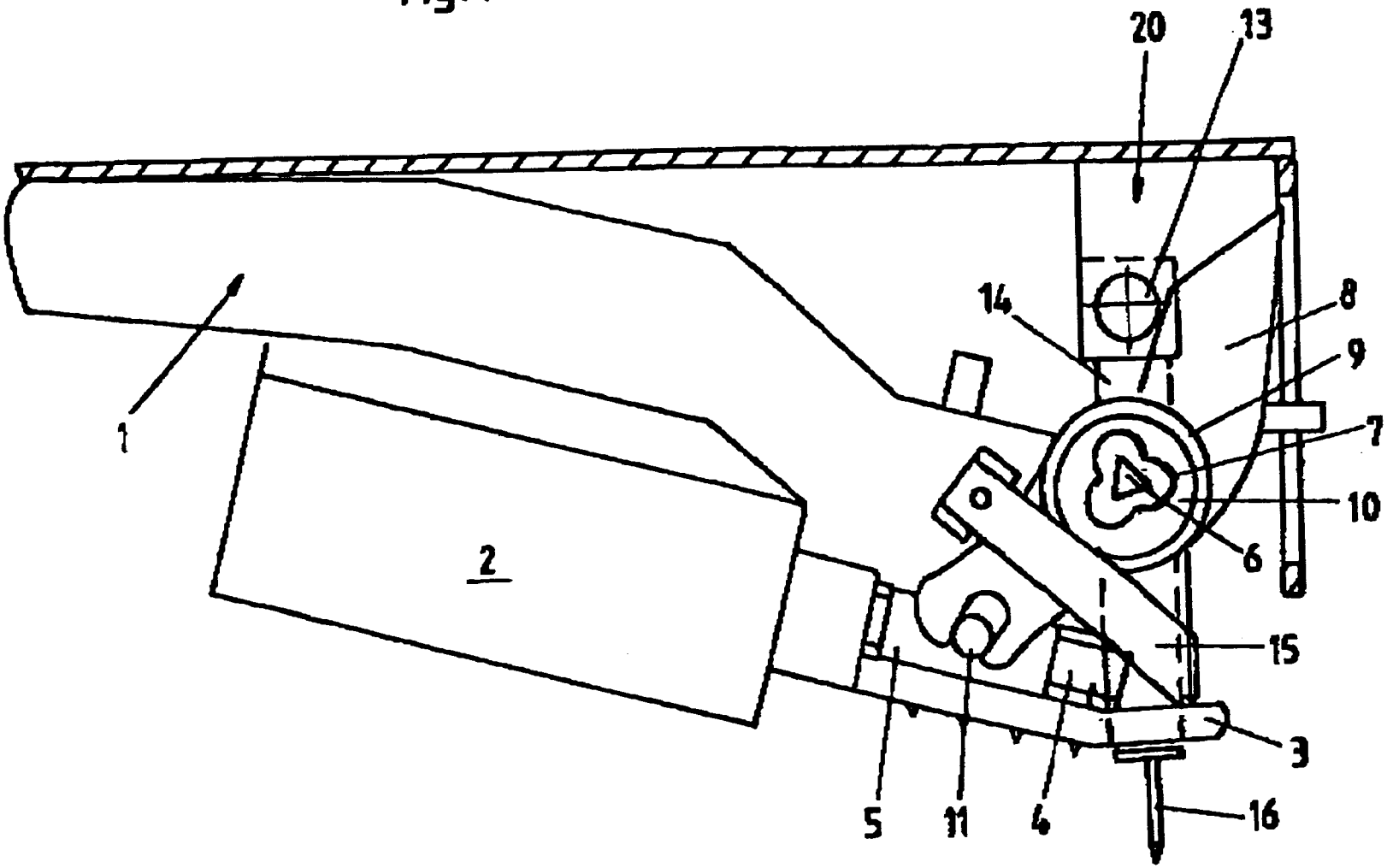
FIG. 4 shows a lateral view according to FIG. 1 with the nailing device in the position when the nail is driven in, i.e. the striker is in its lowest position in the drive hole and the feeder is retracted with the help o the rocker arm.

In FIG. 4 the nailing device is shown in the position in which a nail 16 is just being driven in, i.e. the striker 14, which is set on the bearing bolt or, in this case, on the contact bolt 13, is located in its lowest position in the drive hole 15 and punches the nail 16 out of the device into the nailing substrate. The feeder 5 is pushed back over the bolt 11 from the rocker arm 8 in the opening 4 of the hammerhead 3, so that neither the feeder 5 nor the feed teeth 17 attached to it interfere with the striker 14 when driving the nail 16. The rubber filler 10 is tensed in this position and resets the feeder 5 when releasing the nailing device, whereby the feed teeth 17 located on the feeder 5 lead nails 16 in direction of and through the drive hole.

Figure 5:
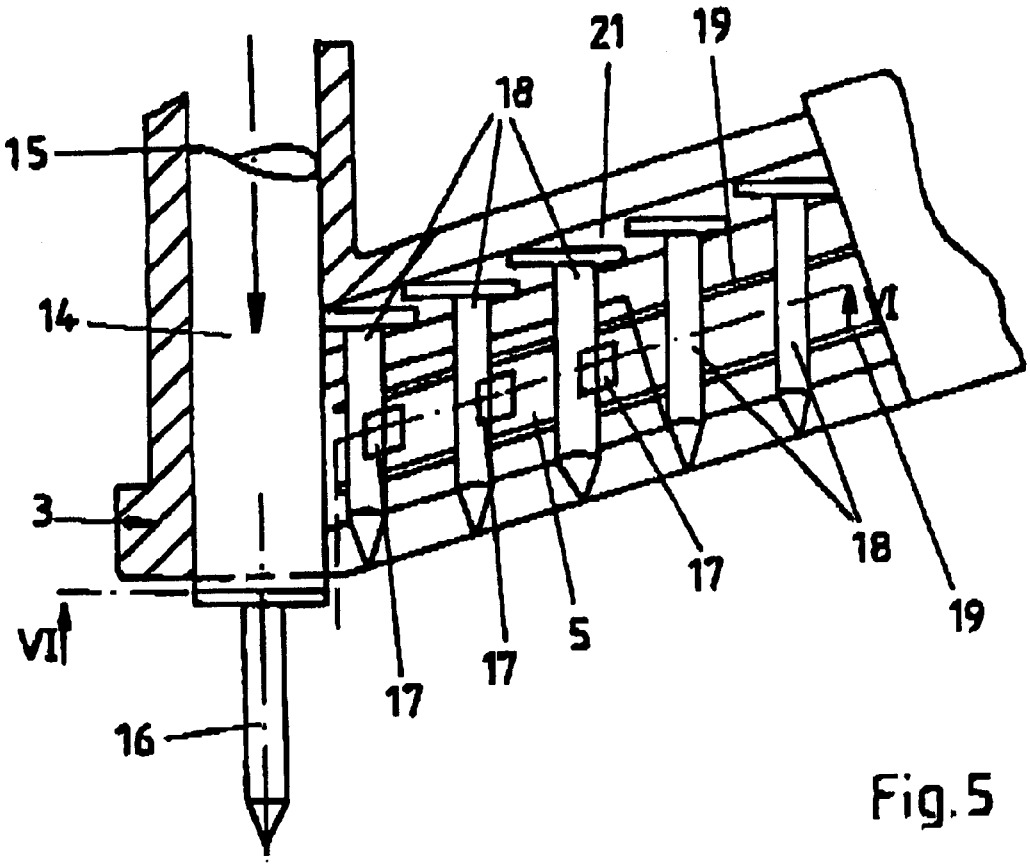
FIG. 5 shows a detailed view of the hammerhead, where the striker is also located in its lowest position in the drive hole while the feeder is retracted.

FIG. 5 shows the feeder in detail from the opposite side. The striker 14 is also located at its lowest point in the hammerhead 3 in this illustration. At this moment the nail 16 is being driven into the substrate immediately before the nail 16, which is in the drive hole 15, is driven, i.e. shortly before the striker 14 reaches its lowest point, the nail 16 is released by retracting the feeder 5 so that at the moment of impact neither the front edge of the feeder nor the front feed tooth 17 extend into the drive hole 15. Thus, there is no interference with the striker 14 when driving in the nail 16. The other nails 18 are linked with a connecting wire 19 into a nail belt and the nail heads are passed through a slot 21, which is preferably provided in the hammerhead 3. Smooth, reliable retraction of the feeder 5 is facilitated by the interaction of surface 12 with contact bolt 13 which moves the rocker arm 8.

Figure 6:
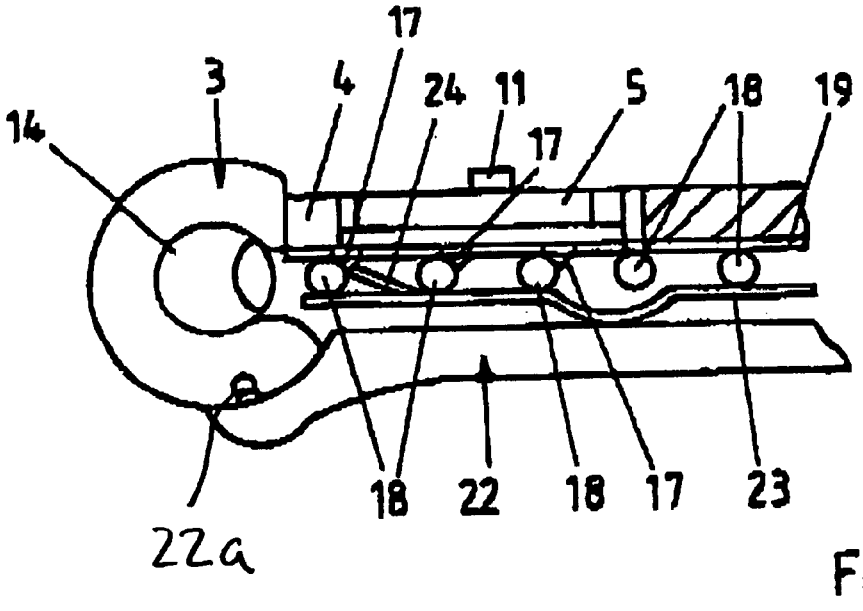
FIG. 6 shows a partial section of the hammerhead, the lower part of the magazine and a nail feed along line VI—VI in FIG. 5.

FIG. 6 shows the striker 14, in its lowest position, in the drive hole 15, i.e. as in FIG. 5 at the moment when a nail is being driven in and the nailing device is not yet released. The feeder 5 is held by the rocker arm 8 in the retracted position in the opening 4 above the screw 11, which is not illustrated here. Feed teeth 17 are located behind the first three nails 18. From the other side the nails 18 are lead in the area of their shafts by the retaining spring 23, which is fixed to and supported by the lower part of the magazine 22. When releasing the nailing device the striker 14 is retracted into the drive hole, the rocker arm 8 is repositioned by the rubber filler 10 and pushes the feeder 5 and, therefore also the nail belt with its nails 18 ahead, so that the foremost nail 16 enters into the drive hole and the next nail 18 is positioned by the retaining tooth 24. When driving in the nail 16 located in the drive hole 15, the feeder is preferably pushed back again, with a retaining tooth 24 preventing the nails 18 from being pulled back. The retaining spring 23 evades the nails 18 so that the feed teeth 17 can be pulled back past the nails 18. Preferably, the spring is comprised of metal or metal alloy and includes one or more retaining teeth24 offset from the retaining spring 23.

In accordance with an embodiment, feed teeth 17 may be spring mounted in feeder 5. This allows feed teeth 17 to avoid nails that are held by retaining spring 23 during retraction of feeder 5.

In keeping with the invention, shaft 6 is firmly linked to the hammerhead 3 or is made integral with hammerhead 3. In any case, shaft 6 extends through an opening in the rocker arm 8. Rubber filler 10 dampens the forces that arise at the bearing of rocker arm 8 from the driving motion to reduce wear and tear on the bearings. Accordingly, the bearings experience significantly less wear than in conventional nailing devices. In addition, the rubber generates a reset force for the feeder 5, which is retracted in the driving motion, and provides safe positioning of the next nail in the drive hole.

Figure 7:
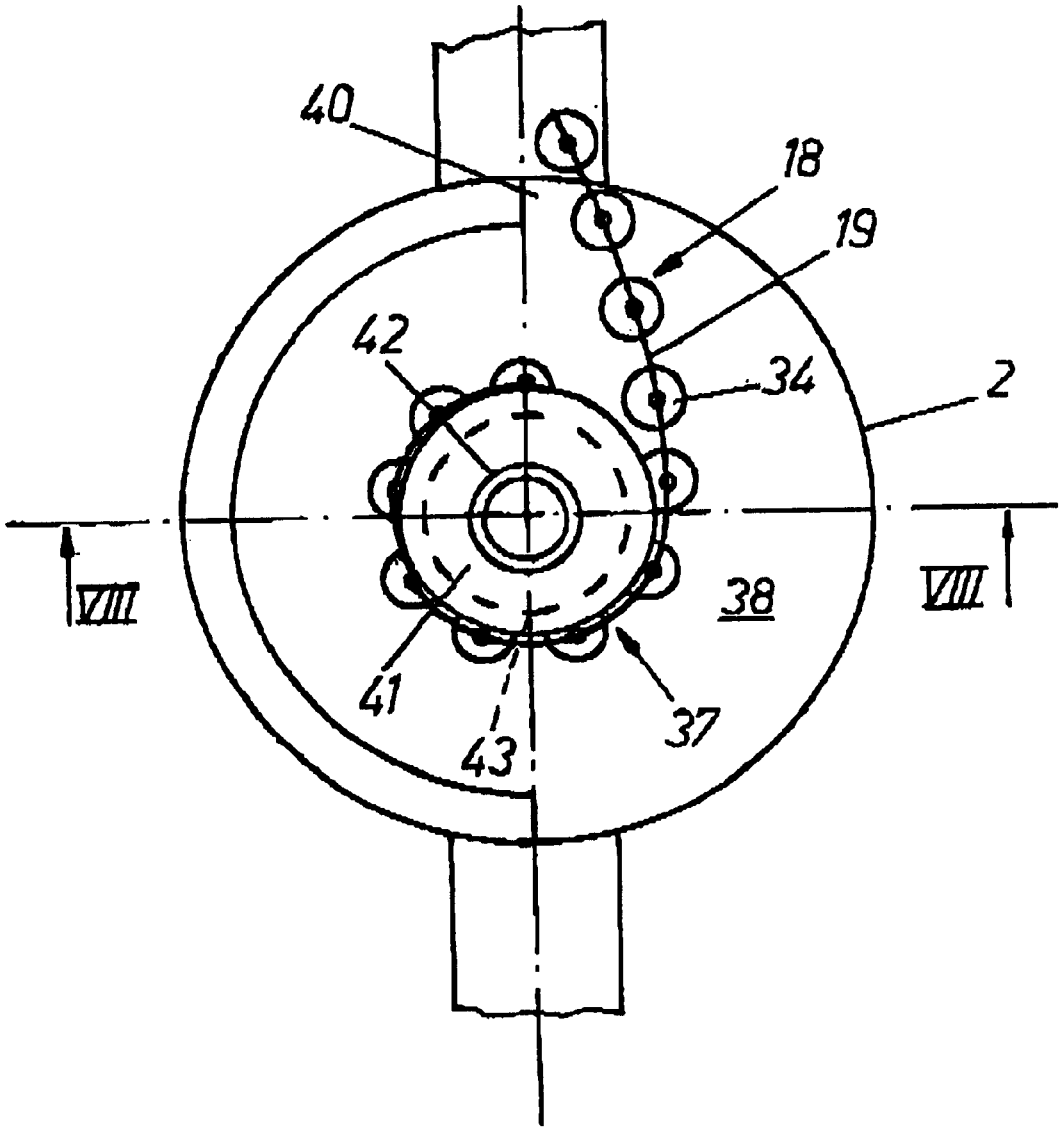
FIG. 7 shows a partial top view of the magazine of the nailing device.
Figure 8:
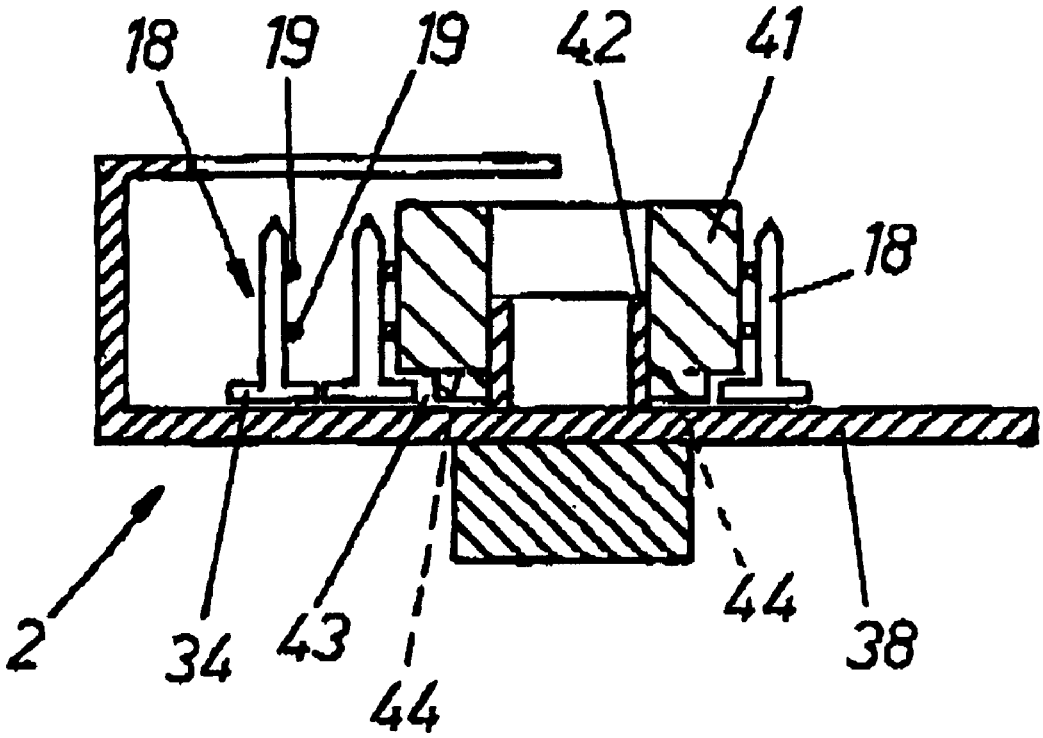
FIG. 8 is a section along lines VIII—VIII in FIG. 7.

FIG. 7 shows a top view of the nailing device magazine as presented in EP 0 121 440. Those parts of the nailing device that are not relevant here and the lid of the magazine have been omitted for the sake of simplicity. A nail belt coil 37 lies inside magazine 2. Nail belt coil 37 preferably includes a series of nails 18 that are linked into a band by two connecting wires 19 disposed one above the other as illustrated in FIG. 8. Connecting wires 19 are preferably tempered and have a tensile strength of between about 392–539 N/mm$^2$. The end of the nail coil 37 is illustrated with a large number of nails 18 already fed. The magazine 2 preferably includes a bottom portion 38 and a similarly formed lid (not shown) and an opening 40 through which nails 16 are fed. A mandrel 42 is provided on the bottom surface 38.

In keeping with the invention a spooling core 41 engaged with mandrel 42. Nail coil 37 is wrapped around spooling core 41. In accordance with one embodiment, spooling core 41 includes is provided with a ring-shaped slot 43 facing the bottom surface 38 in which the nail heads 24 may be nestled. In accordance with a second embodiment, the spooling core 41 may comprise a cylinder. In this embodiment, the nail coil 37 is preferably a cylinder. Here, nail coil 37 is preferably wound about the spooling core 41 such that nail heads 34 are freely disposed below spooling core 41.

When unwinding the nail belt coil 37 during nailing device operation, the spooling core 41 functions to ensure that the innermost layer of the nail belt coil 37 is held vertical by the cylindrical surface of the spooling core 41. This is true even when the nail belt coil 37 is largely unwound, as illustrated in FIG. 7.

In FIG. 8 a section along the line VIII—VIII of FIG. 7 is illustrated, with a second coil layer shown on the left side. The ring-shaped slot 43 is cut sufficiently deep to allow the nail heads 34 sufficient space. The nail belt coil 37 may be pre-wound on the spooling core 41 so that the nail belt coil 37 is coupled to mandrel 42 together with the spooling core 41. Alternatively, the spooling core 41 may be provided separately as an accessory of the nailing device, whereby the spooling core 41 is inserted centrally in a prepared nail belt coil 37 that is wound about mandrel 42.

The height of the spooling core 41 is preferably equal to the height of the nail belt coil 37. In any case, it is preferable that either the nails 18 of the inner core layer or its two connecting wires 19 rest on the cylinder surface of the spooling core 41. It should be noted that when the connecting wires 19 are tempered, their hardness changes and limits bending and compression. This in turn means that the displacement of nails, which are brought in, can be controlled and predicted more effectively and faulty nail feeds may be minimized.

In accordance with another aspect of the invention, the coiling nail belt 37 may include a plurality of nails that holds nails liked by at least tow wires, whereby the wires are tempered and have a tensile strength of 392–539 N/mm2 (40–55 kp/mm2). interference from jamming and wedging of the nails is virtually impossible when operating the nailing device.

While the invention has been disclosed with reference to a limited number of embodiments, it is apparent that variations and modification may be made therein, and it is therefore intended in the following claims to cover each such variation and modification as falls within the true spirit and scope of the invention.

What is claimed is:

1. A nailing device for a coiled nail belt comprising:

an upper body portion including a handle and an arm portion;

a nail magazine attached to the arm;

a hammerhead coupled to said nail magazine and attached to the arm, said hammerhead including a drive hole having a substantially cylindrical aperture, a track and a shaft disposed substantially perpendicular to the drive hole and fixed to said hammerhead;

a nail feeder disposed in the track of said hammerhead a rocker arm coupled to the shaft, said rocker arm including an opening, the shaft extending through the opening leaving a void between an inner most boundary of the opening and an outer most boundary of the shaft, said rocker arm being coupled to said nail feed to displace said nail feed responsive to forces exerted on said hammerhead;

a striker fixed to said upper body portion, said striker being driven through the drive hole of said hammerhead upon application of force to said hammerhead; and rubber filler disposed within the opening in the rocker arm and filling the void between the inner most boundary of the opening and an outer most boundary of the shaft.

2. The nailing device of claim 1 further comprising a star-shaped casing surrounding the shaft.

3. The nailing device of claim 2 where the shaft is triangular.

4. The nailing device of claim 1 further comprising a miter gage including a contact bolt disposed in said upper body portion wherein said rocker arm includes a contact surface facing away from said nail such that the contact surface slides along the contact bolt responsive to movement of the rocker arm the rocker arm.

5. The nailing device of claim 4, the contact bolt attaches said striker to the arm.

6. The nailing device of claim 1 wherein said nail feeder includes a plurality of spring-mounted feed teeth.

7. The nailing device of claim 6, wherein said feeder includes at least two fixed feed teeth.

8. The nailing device of claim 7 wherein the fixed feed teeth are made of steel.

9. The nailing device of claim 1 further comprising a magazine arm coupled to said hammerhead and disposed opposite the track of said hammerhead, the magazine arm including a retaining spring to guide the nail belt and secure the nail belt against retraction.

10. The nailing device of claim 9, wherein the retaining spring includes retaining teeth that are offset from the spring.

11. The nailing device of claim 1, further comprising a spooling core engaged with a mandrel of said magazine, wherein an external diameter of the spooling core is equal to an internal diameter of the nail coil and wherein the spooling core includes a surface contiguous to the nail coil.

12. The nailing device of claim 11, wherein the spooling core includes a cylindrical body, the spooling core being disposed on a mandrel of said magazine and being raised from a bottom surface of said magazine by a sufficient amount to allow a nail head to fit under the spooling core.

13. The nailing device of claim 11 wherein the spooling core includes a cylindrical body having a groove disposed therein to accommodate nail heads.

14. The nailing device according to one of claims 11 wherein the spooling core is rotatable about the mandrel of said magazine.

15. The nailing device of claims 11 wherein the spooling core has a height equal to a width of the nail belt.

16. A coiled nail belt for use with the nailing device of claims 1, including a plurality of nails that are linked with at least two wires, the wires being tempered and having a tensile strength of 392–539 $N/mm^2$.

* * * * *